United States Patent [19]

Batchelor

[11] Patent Number: 4,706,323

[45] Date of Patent: Nov. 17, 1987

[54] SPONGE MOP RETAINER WITH RETRACTION ROD HOOK RECEIVING CATCH

[75] Inventor: Douglas R. Batchelor, Chicago, Ill.

[73] Assignee: Libman Broom Company, Arcola, Ill.

[21] Appl. No.: 946,906

[22] Filed: Dec. 29, 1986

[51] Int. Cl.[4] ..... A47L 13/144

[52] U.S. Cl. ..... 15/119 A

[58] Field of Search ..... 15/244 R, 119 A, 116 A

[56] References Cited

U.S. PATENT DOCUMENTS

| | | | |
|---|---|---|---|
| 3,727,259 | 4/1973 | Wilson | 15/119 A |
| 4,196,488 | 4/1980 | Barry | 15/119 A |
| 4,481,688 | 11/1984 | Graham | 15/119 A |
| 4,491,998 | 1/1985 | Wilson et al. | 15/119 A |
| 4,516,287 | 5/1985 | Johnson et al. | 15/119 A |

FOREIGN PATENT DOCUMENTS

| | | | |
|---|---|---|---|
| 985124 | 3/1965 | United Kingdom | 15/119 A |
| 1129253 | 10/1968 | United Kingdom | 15/119 A |

*Primary Examiner*—Chris K. Moore

*Attorney, Agent, or Firm*—Marshall, O'Toole, Gerstein, Murray & Bicknell

[57] ABSTRACT

A roller sponge mop sponge retainer comprising an elongated channel shaped sponge retainer adapted to receive and securely hold a roll mop sponge; the retainer having a top and two spaced apart side walls extending downwardly from the top; the elongated retainer top having a central section hook catch terminating in end edges lateral to the top; the retainer top adjacent each end edge of the central section comprising a depressed portion having an end edge vertically lower than the adjacent central section end edge; each pair of adjacent central section end and depressed portion end edges defining an opening into which an operating rod hook can be operatively inserted; each depressed portion having a raised element; the raised elements being spaced apart a distance slightly greater than the length of the rod hook adapted to be longitudinally positioned beneath the central section hook catch; and the raised elements restricting longitudinal movement of the hook relative to the retainer central section hook catch.

7 Claims, 6 Drawing Figures

SPONGE MOP RETAINER WITH RETRACTION ROD HOOK RECEIVING CATCH

This invention relates to sponge mops. More particularly, this invention is concerned with an improved sponge retainer for a roller sponge mop.

BACKGROUND OF THE INVENTION

Sponge mops of various types and designs have been commercially available for many years. They are widely used in the home because of their light weight and efficiency in cleaning kitchen and bathroom floors and other surfaces.

One specific type of sponge mop is referred to as a roller sponge mop. Such a mop has a sponge mounted in a retainer. The mop includes a rod which has a hook at one end which engages the retainer. When the rod is displaced in one direction the sponge is moved between opposing rollers which apply pressure and wring water out of the sponge. Movement of the rod in the opposite direction moves the sponge outwardly from between the rollers into cleaning position. One such roller sponge mop is disclosed in Johnson et al U.S. Pat. No. 4,516,287.

Because the sponge has a limited useful life it must be replaced periodically. Accordingly, roller sponge mops are provided with a replaceable cleaning assembly consisting of a sponge mounted in an elongated channel member or retainer. One such replaceable cleaning assembly is disclosed in Wilson U.S. Pat. No. 3,727,259. However, the assembly disclosed in the Wilson patent requires a separate latch plate to secure the rod hook in place in the retainer. This complicates removing a worn assembly from the mop and installing a new assembly. A need thus exists for a simpler structure which will facilitate installation and removal of a replaceable cleaning assembly used on a roller sponge mop.

SUMMARY OF THE INVENTION

According to the invention a roller sponge mop sponge retainer is provided comprising an elongated channel shaped sponge retainer adapted to receive and securely hold a sponge; the retainer having a top and two spaced apart side walls extending downwardly from the top; the elongated retainer top having a central section hook catch terminating in end edges lateral to the top; the retainer top adjacent each end edge of the central section comprising a depressed portion having an end edge vertically lower than the adjacent central section end edge; each pair of adjacent central section end, and depressed portion end, edges defining an opening into which an operating rod hook can be operatively inserted; each depressed portion having a raised element; the raised elements being spaced apart a distance slightly greater than the length of the hook adapted to be positioned beneath the central section hook catch; and the raised elements restricting longitudinal movement of the hook relative to the retainer central section hook catch.

The retainer can be a sheet metal stamping which can be produced inexpensively.

The adjacent end edges of the retainer top central section and each depressed portion can be formed by a single cut through the retainer top.

Each raised element can have an end edge above the depressed portion which defines an opening, and the raised element end edge can face an adjacent central section end edge. Also, each depressed portion can have a ledge, between the raised element and the depressed portion end edge, against which the hook can press when forced downwardly.

Desirably, each end edge of the central section can have a raised area on each side of the longitudinal center line of the retainer to facilitate inserting the free end of the hook at an angle to the said center line beneath the central section until the hook free end reaches the raised element on the other side of the central section and the hook other end passes the other raised element and is pivoted into alignment with the longitudinal center line of the retainer thereby preventing the hook from being displaced longitudinally from beneath the central section. The central section can also have a longitudinal ridge in which the hook can nest.

DETAILED DESCRIPTION OF THE DRAWINGS

To the extent it is reasonable and practical the same or similar elements which appear in the various views of the drawings will be identified by the same numbers.

Figure 1:
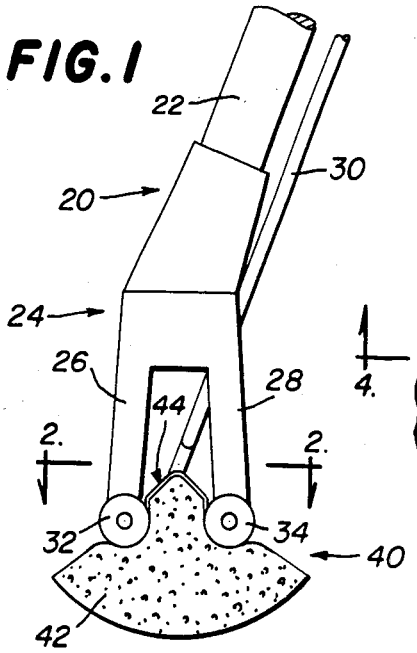
FIG. 1 is a side elevational view of the lower portion of a roller sponge mop having a replaceable cleaning assembly using a sponge retainer according to the invention.
Figure 3:
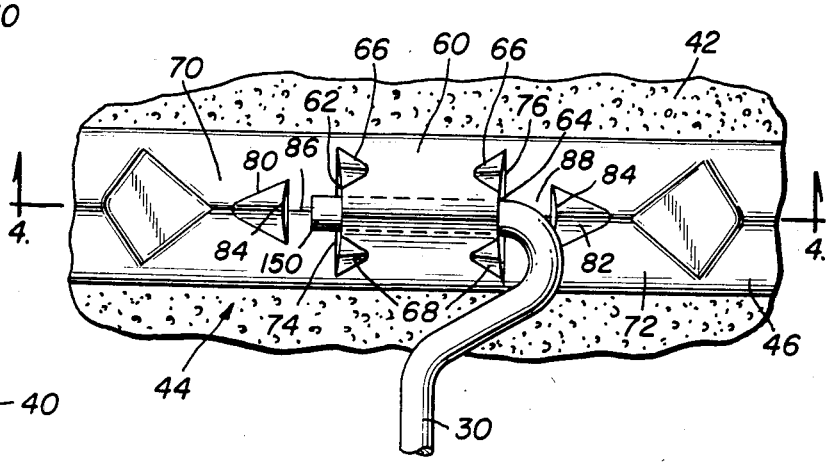
FIG. 3 is an enlarged view of the central part of the cleaning assembly shown in FIG. 2.
Figure 2:
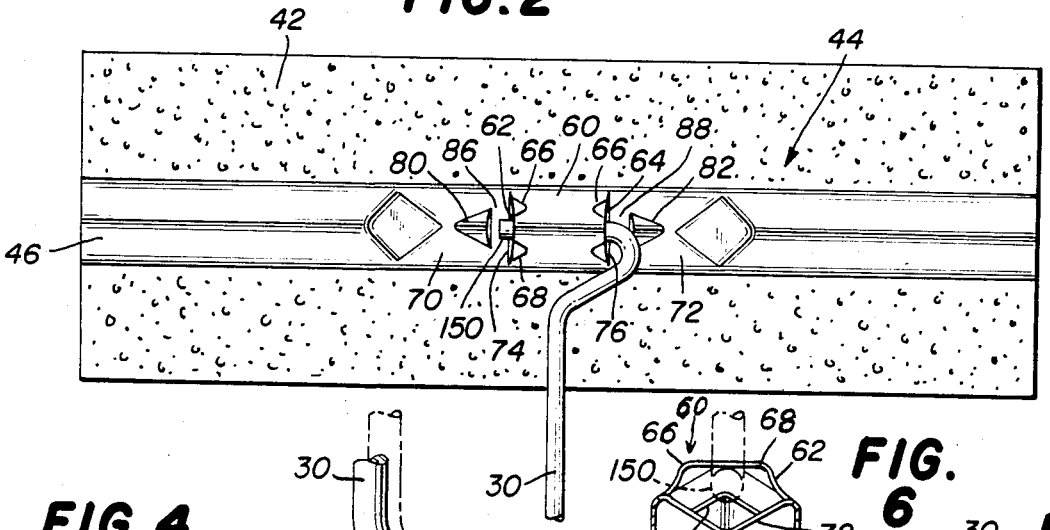
FIG. 2 is a plan view of the cleaning assembly taken along the line 2—2 of FIG. 1.
Figure 4:
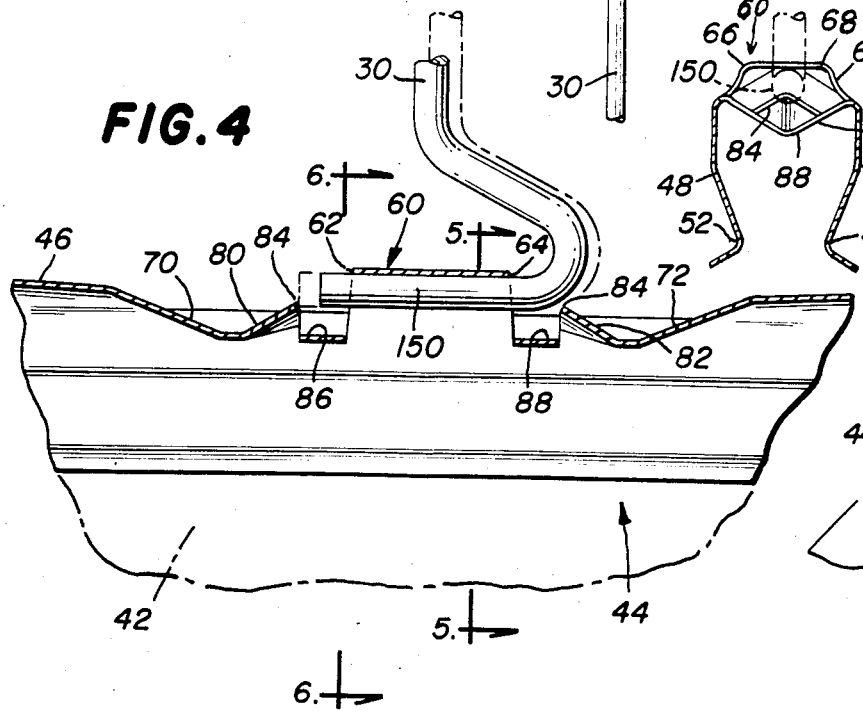
FIG. 4 is a sectional view taken along the line 4—4 of FIG. 3.

As shown in FIG. 1 the roller sponge mop 20 has a handle 22 with a head 24 at the lower end. The head 24 has spaced apart walls 26,28 which define a slot into which the cleaning assembly 40 can be partially retracted by operating rod 30. A pair of spaced apart rollers 32,34 are mounted on the ends of walls 26,28.

The cleaning assembly 40 consists of a resilient sponge 42 secured in the elongated channel shaped sponge retainer 44, which can be made of sheet metal formed by dies in a stamping operation.

Figure 6:
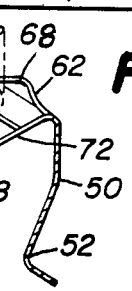
FIG. 6 is a sectional view taken along the line 6—6 of FIG. 4.
Figure 5:
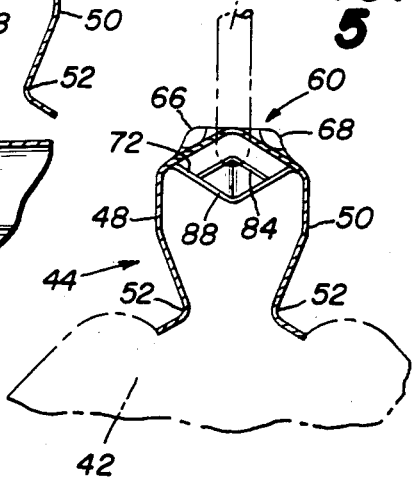
FIG. 5 is a sectional view taken along the line 5—5 of FIG. 4.

Sponge retainer 44 has a top 46 and two spaced apart mirror image side walls 48,50 extending downwardly from the top. The walls 48,50 have recesses 52 (FIGS. 5 and 6) in which the rollers 32,34 nest (FIG. 1) when the cleaning assembly is in extended position ready for use in cleaning a floor.

The retainer top 46 has a central section hook catch 60 which terminates in end edges 62,64 lateral to the top 46. Each end edge 62,64 has a pair of raised areas 66,68, with one raised area on each side of the retainer longitudinal center line. These raised areas provide clearance for the hook 100, on the end of rod 30, to be inserted beneath, and withdrawn, from the central section 60 although only one such raised area is used at any one time.

Adjacent each end edge 62,64 of the central section 60 is a respective depressed portion 70,72. These depressed portions have respective end edges 74,76 formed by cuts through the top of the retainer. The cuts also form the end edges 62,64 of the central portion.

The respective adjacent pairs of end edges 62,74 and 64,76 define openings into which the hook 150 can be inserted.

The depressed portion 70 has a raised element 80 and the depressed portion 72 has a raised element 82. The raised elements 80,82 are identical and are spaced apart a distance slightly greater than the length of hook 150, thereby permitting the hook to be positioned between these raised elements. Each raised element 80,82 has an end edge 84 above the adjoining depressed portion surface. The end edge defines an opening formed by cutting the sheet metal and deforming it during stamping. The raised element end edges 84 face the adjacent central section end edges 62,64.

A ledge 86 is located between raised portion 80 and the depressed portion end edge 74. Similarly, a ledge 88 is located between raised portion 82 and the depressed portion end edge 76. The ledges 86,88 provide support means for the ends of hook 150 when rod 30 moves forward and pushes the cleaning assembly into cleaning position as shown in FIG. 1.

When a cleaning assembly 40 is to be mounted on the mop head 24 the rod 30 is advanced until the hook 150 extends past rollers 32,34. Then the end of hook 150 is directed at an angle into the opening at one end of central section 60 and beneath one of the raised areas 66,68. After the hook has been moved in far enough for the end to contact a raised element 80 or 82 the hook is pivoted until it is in line with the longitudinal center line of the retainer 44. When so aligned the hook nests in ridge 90 in the top of the central section 60. Ridge 90 is positioned along the longitudinal center line of the retainer. When the hook 150 is so positioned the raised elements 80,82 prevent relative longitudinal displacement between the retainer and the hook, thereby preventing them from becoming separated during use of the mop in cleaning. This is because the hook free end and the heel or closed end of the hook abutt the raised elements 80,82 thereby preventing longitudinal movement. Once the cleaning assembly is mounted on the hook 150, rod 30 is retracted until the cleaning assembly is brought into position as shown in FIG. 1 with the retainer seated between rollers 32,34. To wring the sponge the rod 30 is retracted further to bring the sponge between the rollers following which the rod 30 is advanced to return the sponge to the cleaning position (FIG. 1).

The foregoing detailed description has been given for clearness of understanding only, and no unnecessary limitations should be understood therefrom, as modifications will be obvious to those skilled in the art.

What is claimed is:

1. A roller sponge mop sponge retainer comprising:

an elongated channel shaped sponge retainer adapted to receive and securely hold a roll mop sponge;

the retainer having a top and two spaced apart side walls extending downwardly from the top;

the elongated retainer top having a central section hook catch terminating in end edges lateral to the top;

the retainer top adjacent each end edge of the central section comprising a depressed portion having an end edge vertically lower than the adjacent central section end edge;

each pair of adjacent central section end, and depressed portion end, edges defining an opening into which an operating rod hook can be operatively inserted;

each depressed portion having a raised element;

the raised elements being spaced apart a distance slightly greater than the length of the rod hook adapted to be longitudinally positioned beneath the central section hook catch; and the raised elements restricting longitudinal movement of the hook relative to the retainer central section hook catch.

2. A sponge retainer according to claim 1 in which the retainer is a sheet metal stamping.

3. A sponge retainer according to claim 2 in which the adjacent end edges of the central section and each depressed portion is formed by a single cut in the retainer top.

4. A sponge retainer according to claim 3 in which each raised element has an end edge above the depressed portion and defining an opening, and with the raised element end edge facing an adjacent central section end edge.

5. A sponge retainer according to claim 1 in which each depressed portion has a ledge, between the raised element and the depressed portion end edge, against which the hook presses when forced downwardly.

6. A sponge retainer according to claim 1 in which each end edge of the central section has a raised area on each side of the longitudinal center line of the retainer to facilitate inserting the free end of the hook, at an angle to the said center line beneath the central section, until the hook free end reaches the raised element on the other side of the central section and the hook passes the other raised element and is pivoted into alignment with the longitudinal center line of the retainer thereby preventing the hook from being displaced longitudinally from beneath the central section.

7. A sponge retainer according to claim 6 in which the central section has a longitudinal ridge beneath which the hook can nest.

* * * * *